US010969207B1

(12) United States Patent
Tanielian

(10) Patent No.: US 10,969,207 B1
(45) Date of Patent: Apr. 6, 2021

(54) MAGNETICALLY ENHANCED EMP GENERATING DEVICE

(71) Applicant: The Boeing Company, Chicago, IL (US)

(72) Inventor: Minas H. Tanielian, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/808,954

(22) Filed: Mar. 4, 2020

(51) Int. Cl.
*F42B 12/20* (2006.01)
*H01F 7/02* (2006.01)

(52) U.S. Cl.
CPC ..... *F42B 12/207* (2013.01); *H01F 7/02* (2013.01)

(58) Field of Classification Search
CPC ..... F41H 13/0093; F42B 1/00; F42B 12/36
USPC ..... 89/102, 1.14; 102/378
See application file for complete search history.

(56) References Cited

U.S. PATENT DOCUMENTS 3,150,848 A * 9/1964 Lager ..... F41H 11/02 244/3.16
3,221,875 A * 12/1965 Paquette ..... H01Q 15/145 342/12
3,754,256 A * 8/1973 Nystrom ..... H01Q 15/145 342/12
3,878,524 A * 4/1975 Olstowski ..... H01Q 15/145 342/5
4,756,778 A * 7/1988 Deitz ..... C06D 3/00 102/334
5,337,671 A * 8/1994 Varmo ..... F42B 12/48 102/334
5,656,794 A * 8/1997 Krone ..... C06D 3/00 149/108.2
5,972,506 A * 10/1999 Leichter ..... H01M 4/583 428/402
6,578,492 B1 * 6/2003 Koch ..... C06D 3/00 102/334
6,635,130 B2 * 10/2003 Koch ..... C06B 27/00 149/108.2
7,343,861 B1 * 3/2008 Baker ..... F41J 2/02 102/336
10,088,278 B1 * 10/2018 Tanielian ..... F41H 13/0093
2010/0254884 A1 * 10/2010 Shenderova ..... B82Y 5/00 423/446
2017/0222265 A1 * 8/2017 Inoue ..... H01M 4/625
2019/0244778 A1 * 8/2019 Dariavach ..... H02H 3/021
2020/0363167 A1 * 11/2020 Furlong ..... F41H 13/0093

* cited by examiner

*Primary Examiner* — Joshua E Freeman
(74) *Attorney, Agent, or Firm* — Parsons Behle & Latimer

(57) ABSTRACT

Apparatuses, systems, and methods for producing an electromagnetic pulse (EMP). Charged-particle intercalated graphite is disposed at least partially around an explosive and both are positioned within a non-geomagnetic magnetic field. The non-geomagnetic magnetic field accelerates charged particles released by the detonation of the explosive. The non-geomagnetic magnetic field may be generated by permanent magnets. The explosive may be formed in a layer with the non-geomagnetic field being oriented perpendicular to the layer. The layer may be form in the shape of a disc. The explosive and the charged-particle intercalated graphite may be positioned within a resonant cavity that is configured to amplify one or more specific frequencies of electromagnetic energy.

20 Claims, 3 Drawing Sheets

MAGNETICALLY ENHANCED EMP GENERATING DEVICE

FIELD OF THE DISCLOSURE

The disclosure herein relates to apparatus, systems, and methods for magnetically enhancing an electromagnetic pulse (EMP) generating device.

BACKGROUND

Description of the Related Art

EMPs may be generated by various mechanisms. For example, a nuclear explosion may be used to generate an EMP. Some disadvantages of using a nuclear explosion to generate an EMP include simultaneous generation of substantial amounts of blast energy, thermal energy, and nuclear radiation, which are very destructive and not localized. Nuclear bombs are part of the strategic arsenal of a few nations and generally unobtainable and/or unsuitable for tactical warfare situations.

Other mechanisms that may be used to create an EMP include a large capacitor bank discharged into a single-loop antenna, a microwave generator, and an explosively pumped flux compression generator. These types of mechanisms may lack mobility, require large amounts of energy, and/or may require a specially modified platform as a carrier, so that the EMP does not damage any of the electronics of the carrier platform itself and making it inoperable.

Another mechanism is the use of a high explosive to accelerate charged particles to generate an EMP. While the use of high explosives may enable such an EMP generating device, the generated EMP from such a device may not have sufficient intensity as the only acceleration of the net charge in the blast wave will contribute to the generation of the EMP.

Other disadvantages may exist.

SUMMARY

The present disclosure is directed to apparatus, systems, and methods to apparatus, systems, and methods for magnetically enhancing an EMP generating device.

One example of the present disclosure is an apparatus that includes an explosive and charged-particle intercalated graphite that is disposed at least partially around the explosive. The apparatus includes a non-geomagnetic magnetic field (i.e., a magnetic field other than the Earth's magnetic field), wherein the charged-particle intercalated graphite and the explosive are positioned within the non-geomagnetic magnetic field. The non-geomagnetic magnetic field may be generated by a first permanent magnet and a second permanent magnet.

The explosive of the apparatus may be formed in the shape of a layer. The non-geomagnetic magnetic field may be orientated perpendicular to the layer of explosive. The layer of explosive may be formed into a disc shape. The apparatus may include a detonator positioned adjacent to the explosive. The explosive may be any one of the available high explosives used in military applications, such as trinitrotoluene, cyclotrimethylenetrinitramine, octogen, or a combination thereof. The charged-particle intercalated graphite may include an alkali metal or bromine.

The charged-particle intercalated graphite may be configured to undergo exfoliation in response to detonation of the explosive. The exfoliation of the charged-particle intercalated graphite may release charged particles. The detonation of the explosive may accelerate charged particles released from the charged-particle intercalated graphite. The non-geomagnetic magnetic field may further accelerate the charged particles released from the charged-particle intercalated graphite. The apparatus may include a resonant cavity with the explosive and the charged-particle intercalated graphite being positioned within the resonant cavity. The resonant cavity may be configured to amplify one or more specific frequencies of electromagnetic energy, which may include microwave frequencies.

One example of the present disclosure is a method of generating an electromagnetic pulse. The method includes releasing charged particles from charged-particle intercalated graphite within a non-geomagnetic magnetic field, the charged particles being released in response to a detonation of an explosive around which the charged-particle intercalated graphite is at least partially disposed. The method includes accelerating the released charged particles with the non-geomagnetic field and emitting, by the accelerate released charged particles, electromagnetic energy.

The method may include initiating, by a detonator, the detonation of the explosive responsive to an input at the detonator. Accelerating the released charged particles may include accelerating the released charged particles, at least in part, from mechanical energy produced by the detonation of the explosive. The non-geomagnetic magnetic field may further increase the acceleration of the released charged particles produced by the detonation of the explosive.

One example of the present disclosure is a system that includes an explosive and charged-particle intercalated graphite that is disposed at least partially around the explosive. The system includes a non-geomagnetic magnetic field with the charged-particle intercalated graphite and the explosive being positioned within the non-geomagnetic magnetic field. The system includes a detonator positioned adjacent to the explosive and an initiator configured to trigger the detonator. The non-geomagnetic magnetic field may be generated by a first permanent magnet and a second permanent magnet. The explosive may be formed in a shape of a layer and the non-geomagnetic magnetic field may be orientated perpendicular to the layer.

Figure 1:
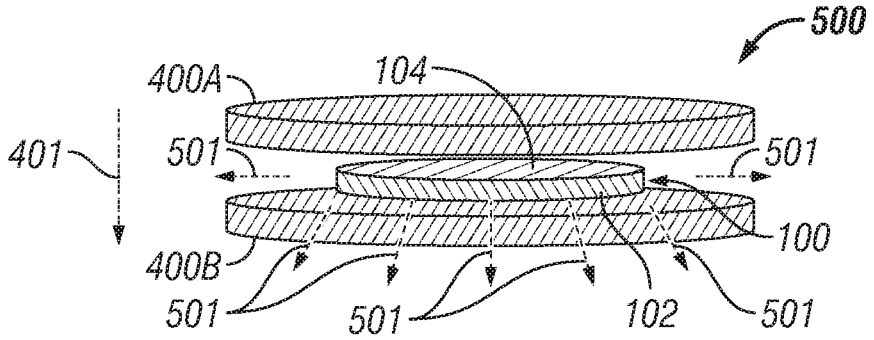
FIG. 1 shows an example of a magnetically enhanced EMP generating device.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an example of a magnetically enhanced EMP generating system 500. The system 500 includes explosive 104 with charged-particle intercalated graphite 102 disposed at least partially around the explosive 104. The charged-particle intercalated graphite 102 may be disposed around a portion of the explosive 104 or may be disposed entirely around the explosive 104. For example, the charged-particle intercalated graphite 102 may be wrapped around the entire perimeter of the explosive 104. The explosive 104 may be a relatively inexpensive high explosive. For example, the explosive 104 may be, but is not limited to, trinitrotoluene, cyclotrimethylenetrinitramine, octogen, or a combination thereof.

The explosive 104 may be formed in the shape of a layer as shown in FIG. 1. The layer of explosive 104 may be formed in various shapes such as, but not limited, to a disc shape as shown in FIG. 1. The layer of explosive 104 may be formed in other shapes such as, but not limited to, various polygons, circles, ellipses, a portion of a circle, and a portion of an ellipse depending on the application.

Figure 2:
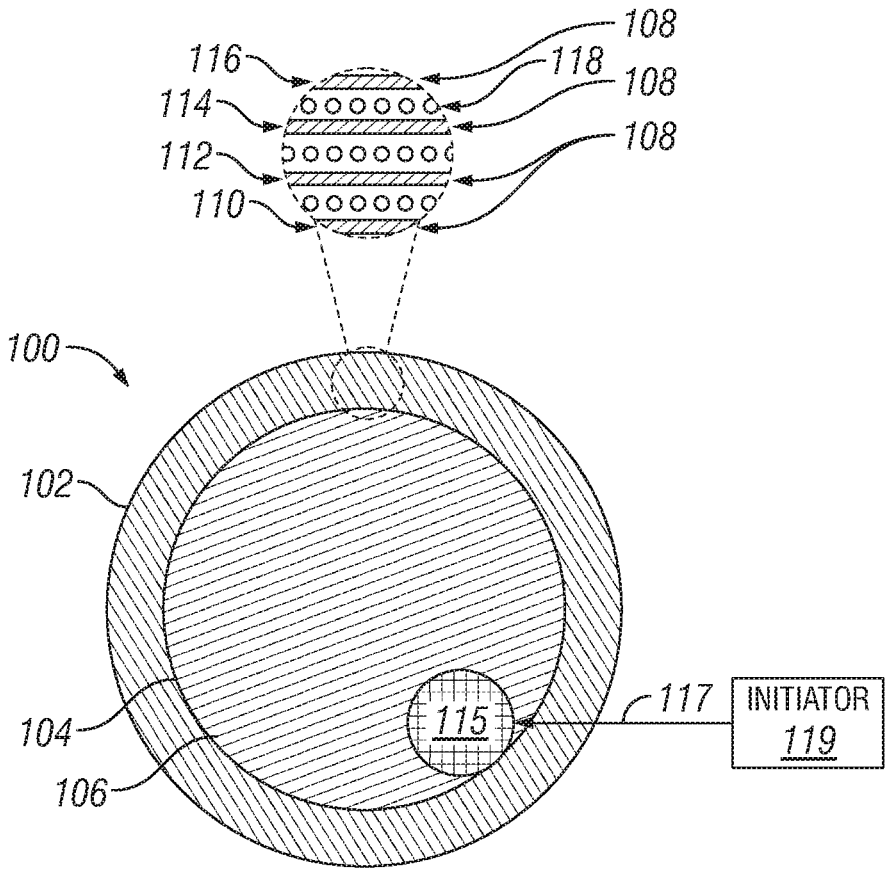
FIG. 2 shows a top view of an example of an EMP generating device that may be magnetically enhanced.

The charged-particle intercalated graphite 102 includes charged particles 118 and graphite 108 that includes multiple layers 110, 112, 114, 116 of graphite material as shown in FIG. 2. The charged particles 118 are intercalated into (e.g., reversibly included in) the graphite 108 (e.g., between the layers 110, 112, 114, 116 of graphite material). The charged particles 118 of the charged-particle intercalated graphite 102 may include bromine, alkali metal, or ions, such as alkali metal ions. The charged particles 118 of the charged-particle intercalated graphite 102 may include, but is not limited to, lithium ions, cesium ions, potassium ions, or a combination thereof. The charged particles 118 may be intercalated into the graphite 108 electrolytically or via immersion of graphite powder in a liquid form of the material of the charged particles 118. For example, the charged particles 118 may be intercalated into the graphite 108 by immersing the graphite 108 into liquid lithium, liquid cesium, liquid potassium, or liquid bromine.

The charged-particle intercalated graphite 102 is configured to release charged particles upon the detonation of the layer of explosive 104 as discussed herein. The detonation of the layer of explosive 104 accelerates the charged particles to create an EMP as discussed herein. The magnetically enhanced EMP generating system 500 includes a non-geomagnetic magnetic field that is normal (i.e., perpendicular) to the layer of explosive 104 as indicated by arrow 401. As used herein, a geomagnetic field is the Earth's magnetic field.

The non-geomagnetic magnetic field 401 further accelerates the charged particles 118 released upon the detonation of the layer of explosive 104 in a direction normal (i.e. perpendicular) to the magnetic field. The non-geomagnetic magnetic field 401 may be generated by a first permanent magnet 400A and a second permanent magnet 400B positioned adjacent to the layer of explosive 104. The non-geomagnetic magnetic field 401 accelerates released charged particles 222 (shown in FIG. 3) normal to the direction indicated by arrows 501 but still on the same plane on which arrows 501 reside to further enhance the EMP generated by detonation of the layer of explosive 104, which causes charged particles 118 to be released from the charged-particle intercalated graphite 102. The acceleration of the charged particles 118 is due to two forces, one acting in the radial direction and generated by the blast wave and a secondary acceleration due to the Lorentz force that is in the normal direction (i.e., perpendicular) to the motion of the charge (in the plane of the layer of explosive 104). A point charge moving outward from the center of the disc (radially) will experience an additional force of $$\vec{F} = \frac{\vec{v}}{c} \times \vec{B}$$

perpendicular to it motion (and thus an acceleration), due to the presence of the non-geomagnetic field.

As shown in FIG. 2, the charged-particle intercalated graphite 102 defines a region 106 within which explosives 104 are disposed. The region 106 may be fully enclosed by the charged-particle intercalated graphite 102. Alternatively, the charged-particle intercalated graphite 102 may be disposed only around a portion of the region 106. The charged-particle intercalated graphite 102 may include one or more slots, apertures, and/or gaps. For example, the charged-particle intercalated graphite 102 may include one or more slots, apertures, and/or gaps to enable an initiator 119 access to a detonator 115 disposed adjacent to the explosive 104 within the region 106. As the explosive 104 is formed in the shape of a layer with the charged-particle intercalated graphite 102 disposed around a least a portion of the explosive 104, the initiator 119 may access the detonator 115 directly by traveling around the side of charged-particle intercalated graphite 102. The layer of the explosive 104 may be formed in a circle, a disc shape, or other polygonal shapes depending on the application.

The explosive 104 may be formed of one or more explosive charges. The explosive 104 may be formed from a high explosive material. For example, the explosive may be, but it not limited to, trinitrotoluene (TNT), cyclotrimethylenetrinitramine (RDX), octogen (HMX), or the like, or a combination thereof. The charged-particle intercalated graphite 102 may be wrapped around a least a perimeter of the layer of explosive 104. In other examples, the charged-particle intercalated graphite 102 may be spaced apart from the layer of explosive 104.

The apparatus 100 includes detonation components, such as a detonator 115 and an initiator 119. The initiator 119 is configured to trigger detonation of the detonation 115, which causes the detonation of the layer of explosive 104. One example of an initiator 119 is a fuse. The initiator 119 provides an input 117 that triggers to detonator 115, which causes the detonation of the layer of explosive 104. The initiator 119 may be configured to be mechanically triggered providing an input 117 such as activation energy to initiate detonation of the detonator 115 and layer of explosive 104. For example, an impact to the apparatus 100 may cause the initiator 119 to trigger detonation. In another example, the initiator 119 may be configured to provide the input 117 to trigger detonation of the layer of explosive 104 via the detonator 115 based on a time sequence. The layer of explosive 104 is configured to store potential energy in the form of chemical energy as opposed to nuclear energy.

The charged-particle intercalated graphite 102 is configured to undergo exfoliation (e.g., separation of the graphitic layers 110, 112, 114, 116) in response to detonation of the layer of explosive 104. The layer of explosive 104 and the charged-particle intercalated graphite 102 may be configured such that the thermal energy, mechanical energy, and/or a combination thereof, from the detonation of the layer of explosive 104 cause the charged-particle intercalated graphite 102 to undergo thermal exfoliation, mechanical exfoliation, and/or a combination thereof.

Figure 3:
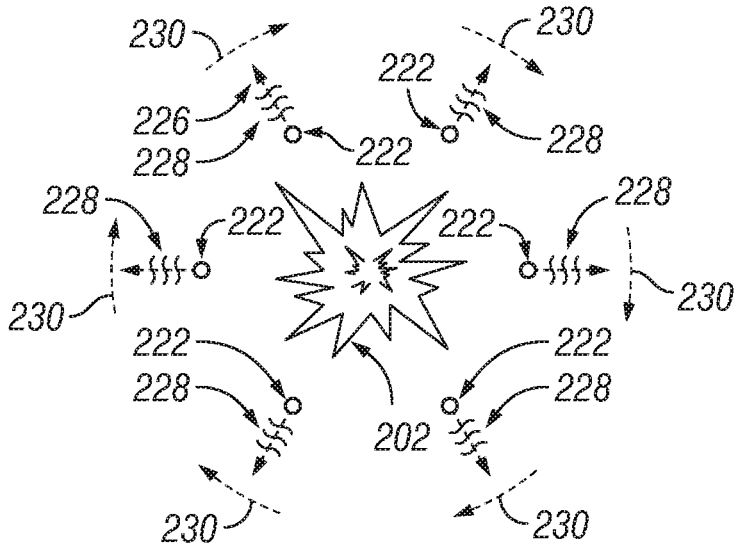
FIG. 3 is a schematic showing a detonation of an explosive material that generates an EMP that is magnetically enhanced.

Exfoliation of the charged-particle intercalated graphite 102 responsive to detonation of the layer of explosive 104 results in deintercalation (e.g., expulsion or removal) of a least some of the charged particles 118 from the charged-particle intercalated graphite 102. FIG. 3 depicts detonation 202 of the layer of explosive 104 (shown in FIGS. 1 and 2) and depicts released charged particles 222 that are deintercalated responsive to exfoliation of the charged-particle intercalated graphite 102 (shown in FIGS. 1 and 2).

The exfoliation of the charged-particle intercalated graphite 102 in response to the detonation 202 of the layer of explosive 104 causes at least some of the charged particles 118 to be released from the charged-particle intercalated graphite 102. In some examples, the exfoliation deintercalates at least 1% of the charged particles in the charged-particle intercalated graphite 102. The percentage of charged particles 118 deintercalated from the charged-particle intercalated graphite 102 may be more or less than 1% depending on the application.

The detonation 202 of the layer of explosive 104 is configured to accelerate, as indicated by dashed arrow 226, the released charged particles 222 to produce electromagnetic (EM) energy 228. EM energy 228 may be, but are not limited to, EM radiation, EM waves, and EMPs. For example, mechanical energy from the detonation 202 of the layer of explosive 104 accelerates 226 the released charged particles 222. The acceleration 226 of the released charged particles 222 causes the released charged particles 222 to emit (e.g., produce) the EM energy 228. The Lorentz force caused by the non-geomagnetic magnetic field 401 (shown in FIG. 1) further accelerates, as shown schematically by dashed arrow 230, the released charged particles 222. The acceleration caused by the Lorentz force will be normal (i.e. perpendicular) to the acceleration (shown by arrow 226) due to the detonation of the layer of explosive 104. The EM energy 228 from acceleration 226, 230 of each of the released charged particles 222 collectively corresponds to an EMP. The acceleration 230 of the released charged particles 222 due to the non-geomagnetic magnetic field 401 may increase the generated EMP by a factor of about 1000. The increase of the generated EMP due to the non-geomagnetic magnetic field 401 may vary depending on the strength of the non-geomagnetic magnetic field 401 applied to the magnetically enhanced EMP generating system 500.

The magnetically enhanced EMP generating system 500 of FIG. 1 is configured to generate an EMP using a layer of explosive 104 with charged-particle intercalated graphite 102 disposed at least partially around the explosive 104 by liberating and accelerating charged particles released from the charged-particle intercalated graphite 102 with the non-geomagnetic magnetic field 501 enhancing the EMP generating by the detonation of the layer of explosive 104. The shape of the layer of explosive 104, the resonant cavity enclosing system 500, and the non-geomagnetic magnetic field 501 may be configured to not only enhance the strength of the EMP generated, but also provide for the direction in which the EMP will be generated. The EMP may include substantial energy within microwave frequencies and non-microwave frequencies. Electronic components may be more susceptible to damage response to EM energy having particular frequencies, such as microwave frequencies. The enhanced EMP generating system 500 may be tuned using a hollow conductor (e.g., a resonant cavity) to produce an EMP that is concentrated in a particular microwave frequency.

Figure 4:
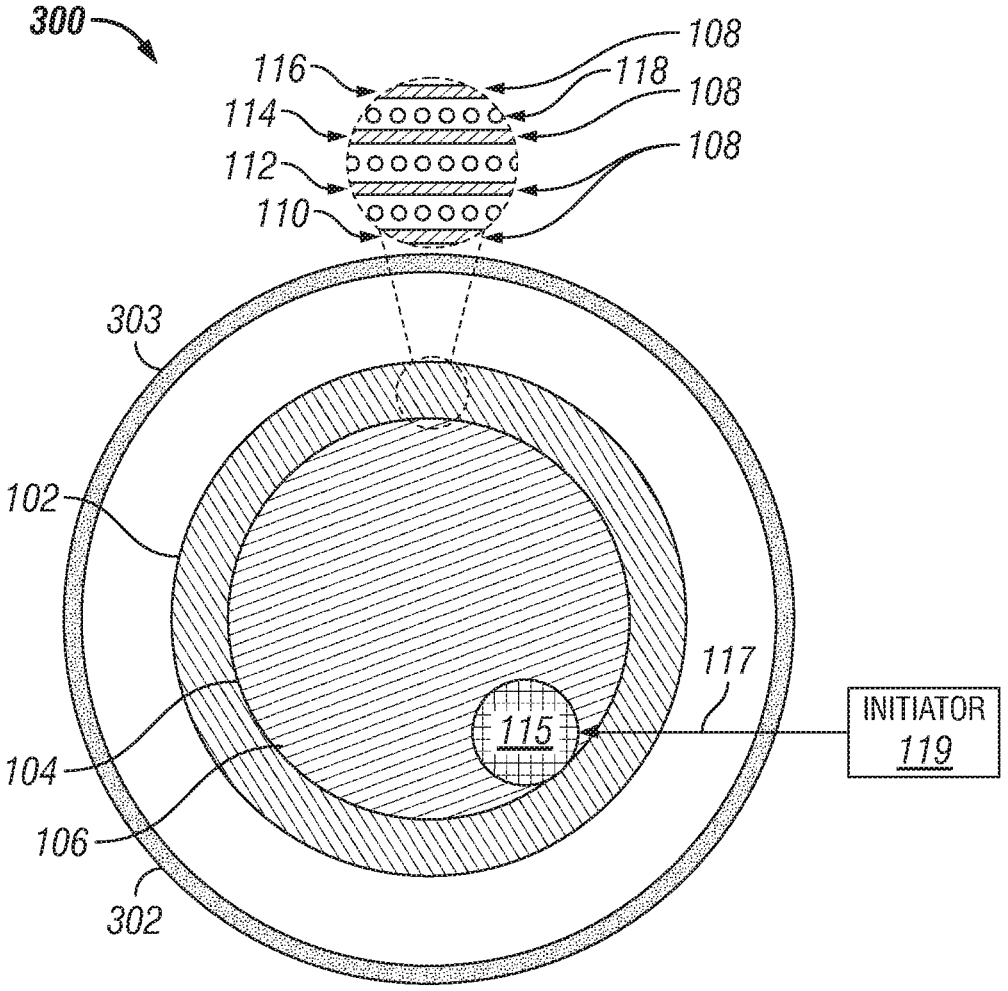
FIG. 4 shows a top view of an example of an EMP generating device that may be magnetically enhanced.

FIG. 4 shows an example of a magnetically enhanced EMP generating device 300 that includes a resonant cavity 302. The non-geomagnetic magnetic field 501 (shown in FIG. 1) and magnets 400A and 400B (shown in FIG. 1) are not shown in FIG. 4 for clarity purposes. However, the EMP generating device 300 would be positioned within a non-geomagnetic field to further accelerate charged particles 118 upon detonation of the layer of explosive 104 to enhance the EMP generated by the device 300. The device 300 includes a layer of explosive 104 positioned within a region 106 that may be defined by charged-particle intercalated graphite 102. The charged-particle intercalated graphite 102 may be wrapped around at least a portion of the layer of explosive 104. As discussed herein, an initiator 119 may provide an input 117 to a detonator 115 positioned within or adjacent to the layer of explosive 104. The input 117 triggers the detonation of the detonator 115, which causes the detonation of the layer of explosive 104.

The resonant cavity 302 includes a cavity wall 303. The cavity wall 303 may be formed of metal or another suitable electrical conductor. In FIG. 4, the resonant cavity 302 is formed in the shape of a circle, but other shapes may be used. In use, detonation of the layer of explosive 104 produces a blast-wave front that propagates toward the cavity wall 303. The blast-wave front travels slower than the EM energy. The device 300 is configured to confine and cause amplification of (or self-reinforcement of) particular frequencies of EM energy 228 (shown in FIG. 3) by resonance prior to the blast-wave front reaching the cavity wall 303. For example, the particular frequencies may correspond to microwave frequencies. The resonant cavity 302 exhibits resonance at the particular frequencies causing amplification of the particular frequencies of the EM energy 228 emitted by the released charged particles.

Figure 5:
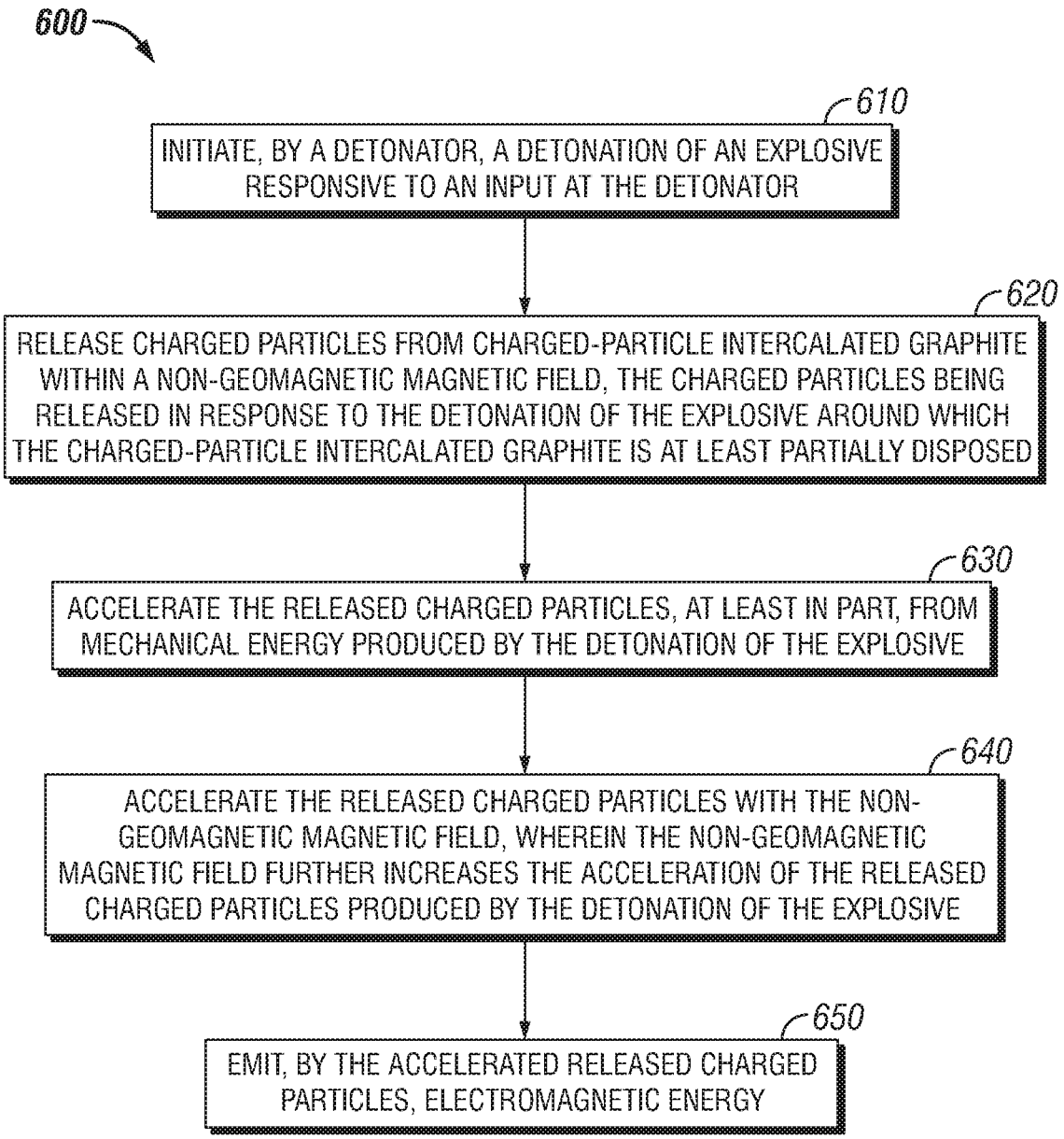
FIG. 5 is flow chart for a method of generating an electromagnetic pulse.

FIG. 5 is flow chart for a method 600 of generating an electromagnetic pulse. The method 600 includes initiating, by a detonator, a detonation of an explosive responsive to an input at the detonator, at step 610. For example, an initiator 119 may provide an input 117 that triggers the detonation of a detonator 115, which causes the detonation of a layer of explosive 104. The method 600 includes releasing charged particles from charged-particle intercalated graphite within a non-geomagnetic magnetic field, the charged particles being released in response to the detonation of the explosive around which the charged-particle intercalated graphite is at least partially disposed, at step 620. For example, charged particles 118 are released from charged-particle intercalated graphite 102 due to detonation of the layer of explosive 104 around which the charged-particle intercalated graphite 102 is at least partially disposed.

The method 600 includes accelerating the released charged particles, at least in part, from mechanical energy produced by the detonation of the explosive, at step 630. For example, the mechanical energy produced by the detonation 202 of the layer of explosive 104 accelerates 226 the released charged particles 222. The method 600 includes accelerating the released charged particles with the non-geomagnetic field, wherein the non-geomagnetic magnetic field further increases the acceleration of the released charged particles produced by the detonation of the explosive, at step 640. For example, the non-geomagnetic magnetic field 401 further modifies the acceleration 230 of the released charged particles 222 produced by the detonation 202 of the layer of explosive 104. The method 600 includes emitting, by the accelerated released charged particles, electromagnetic energy, at step 650. For example, the accelerated 226, 230 released charged particles 222 emit electromagnetic energy 228.

Although this disclosure has been described in terms of certain embodiments, other embodiments that are apparent to those of ordinary skill in the art, including embodiments that do not provide all of the features and advantages set forth herein, are also within the scope of this disclosure.

Accordingly, the scope of the present disclosure is defined only by reference to the appended claims and equivalents thereof

What is claimed is:

1. An apparatus comprising:

an explosive;

charged-particle intercalated graphite, the charged-particle intercalated graphite being disposed at least partially around the explosive; and a non-geomagnetic magnetic field, wherein the charged-particle intercalated graphite and the explosive are positioned within the non-geomagnetic magnetic field.

2. The apparatus of claim 1, wherein the non-geomagnetic magnetic field is generated by a first permanent magnet and a second permanent magnet.

3. The apparatus of claim 2, wherein the explosive is formed in a shape of a layer.

4. The apparatus of claim 3, wherein the non-geomagnetic magnetic field is oriented perpendicular to the layer.

5. The apparatus of claim 4, wherein the layer further comprises a disc shape.

6. The apparatus of claim 2, further comprising a detonator positioned adjacent to the explosive.

7. The apparatus of claim 2, wherein the explosive includes trinitrotoluene, cyclotrimethylenetrinitramine, octogen, or a combination thereof.

8. The apparatus of claim 2, wherein the charged-particle intercalated graphite includes an alkali metal or bromine.

9. The apparatus of claim 2, wherein the charged-particle intercalated graphite is configured to undergo exfoliation in response to detonation of the explosive.

10. The apparatus of claim 9 wherein the exfoliation releases charged particles from the charged-particle intercalated graphite, wherein the detonation of the explosive accelerates the released charged particles, and wherein the non-geomagnetic magnetic field further accelerates the released charged particles to produce electromagnetic energy.

11. The apparatus of claim 2, further comprising a resonant cavity, wherein the explosive and the charged-particle intercalated graphite are positioned within the resonant cavity.

12. The apparatus of claim 11, wherein the resonant cavity is configured to amplify one or more specific frequencies of electromagnetic energy.

13. The apparatus of claim 12, wherein the one or more specific frequencies include microwave frequencies.

14. A method of generating an electromagnetic pulse, the method comprising:

releasing charged particles from charged-particle intercalated graphite within a non-geomagnetic magnetic field, the charged particles being released in response to detonation of an explosive around which the charged-particle intercalated graphite is at least partially disposed;

accelerating the released charged particles with the non-geomagnetic magnetic field; and emitting, by the accelerated released charged particles, electromagnetic energy.

15. The method of claim 14, further comprising initiating, by a detonator, the detonation of the explosive responsive to an input at the detonator.

16. The method of claim 15, wherein accelerating the released charged particles further comprises accelerating the released charged particles, at least in part, from mechanical energy produced by the detonation of the explosive.

17. The method of claim 16, wherein the non-geomagnetic magnetic field further increases the acceleration of the released charged particles produced by the detonation of the explosive.

18. A system comprising:

an explosive;

charged-particle intercalated graphite, the charged-particle intercalated graphite being disposed at least partially around the explosive;

a non-geomagnetic magnetic field, the charged-particle intercalated graphite and the explosive are positioned within the non-geomagnetic magnetic field;

a detonator positioned adjacent to the explosive; and an initiator configured to trigger the detonator.

19. The system of claim 18, wherein the non-geomagnetic magnetic field is generated by a first permanent magnet and a second permanent magnet.

20. The system of claim 19, wherein the explosive is formed in a shape of a layer and wherein the non-geomagnetic magnetic field is oriented perpendicular to the layer.

* * * * *